United States Patent [19]

Munoz

[11] Patent Number: 5,033,681

[45] Date of Patent: Jul. 23, 1991

[54] ION IMPLANTATION FOR FLUID NOZZLE

[75] Inventor: Jose P. Munoz, Joplin, Mo.

[73] Assignee: Ingersoll-Rand Company, Woodcliff Lake, N.J.

[21] Appl. No.: 521,454

[22] Filed: May 10, 1990

[51] Int. Cl.[5] ..... B05B 1/00; E21C 25/60

[52] U.S. Cl. ..... 239/596; 239/602; 239/DIG. 19

[58] Field of Search ..... 239/DIG. 19, 589, 596, 239/602

[56] References Cited

U.S. PATENT DOCUMENTS

| | | | |
|---|---|---|---|
| 3,997,111 | 12/1976 | Thomas et al. | 239/596 |
| 4,150,794 | 4/1979 | Higgins | 239/596 |
| 4,555,062 | 11/1985 | You | 239/602 |
| 4,852,800 | 8/1989 | Murdock | 239/596 |
| 4,897,852 | 1/1990 | Dosaj et al. . | |
| 4,898,712 | 2/1990 | Dosaj et al. . | |
| 4,906,710 | 3/1990 | Burns et al. . | |

*Primary Examiner*—Andres Kashnikow
*Assistant Examiner*—Karen B. Merritt
*Attorney, Agent, or Firm*—Glenn B. Foster

[57] ABSTRACT

A fluid discharge device comprises a nozzle. The nozzle is constructed from a first jewel such as a corundum or diamond. An aggregation of ions formed from a second material such as nickel, titanium or chromium are implanted onto a surface of the nozzle, whereby a useful lifetime of the nozzle with a fluid passing through the nozzle under high pressure, is increased.

14 Claims, 3 Drawing Sheets

CYCLES OF FLUID JET OPERATION PRIOR TO NOZZLE FAILURE

| SAPPHIRE NOZZLE WITHOUT ION IMPLANTATION | | SAPPHIRE NOZZLE WITH NICKEL ION IMPLANTATION |
|---|---|---|
| 590 | MINIMUM CYCLES | 1,407 |
| 932 | | 1,458 |
| 1,000 | | 1,944 |
| 1,134 | | 3,168 |
| 1,420 | | 5,469 |
| 1,476 | | 8,416 |
| 1,668 | | 8,901 |
| 1,888 | | 9,520 |
| 2,150 | | 10,010 |
| 2,244 | | 10,934 |
| 2,482 | | 12,059 |
| 2,858 | | 16,560 |
| 4,023 | | 17,119 |
| 5,187 | | 18,050 |
| 6,072 | | 25,172 |
| 7,173 | MAXIMUM CYCLES | 30,095 |
| AVERAGE 2,644 CYCLES | | AVERAGE 10,877 CYCLES |

FIG. 3

ION IMPLANTATION FOR FLUID NOZZLE

BACKGROUND OF THE INVENTION

This invention relates generally to a nozzle for discharging fluid, and more particularly to a nozzle with ions implanted therein to increase the useful lifetime of the nozzle.

It is well known to construct nozzles in water jet cutters from jewels. These jewels have a tendency to fail at certain times because of imperfections in the structure of the jewel; or exhibit premature damage to the jewel's surfaces as a result of the working fluid/-slurry.

Implantation of certain ions to enhance properties of the material surfaces to increase wear resistance is known with regard to materials such as metals, ceramics, composites and plastics. However, ion implantation in jewels and in particular to nozzles made of such jewels used in waterjet cutting is not known.

The foregoing illustrates limitations known to exist in present waterjet cutters. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid discharge apparatus comprising a nozzle having a surface. The nozzle is constructed from a jewel. An aggregation of ions formed from a second material are implanted onto the surface, wherein a useful lifetime of the nozzle with a fluid passing through the nozzle, under high pressure, is increased.

The foregoing and other aspects will become apparent from the following detailed description of the invention when considered in conjunction with the accompanying drawing figures.

BRIEF DESCRIPTION OF THE DRAWING FIGURES

FIG. 3 is a table illustrating useful lifetime (cycles) of sapphire nozzles with ion implantations of the instant invention compared to identical, but untreated nozzles; under the same operating conditions.

DETAILED DESCRIPTION

Figure 1:
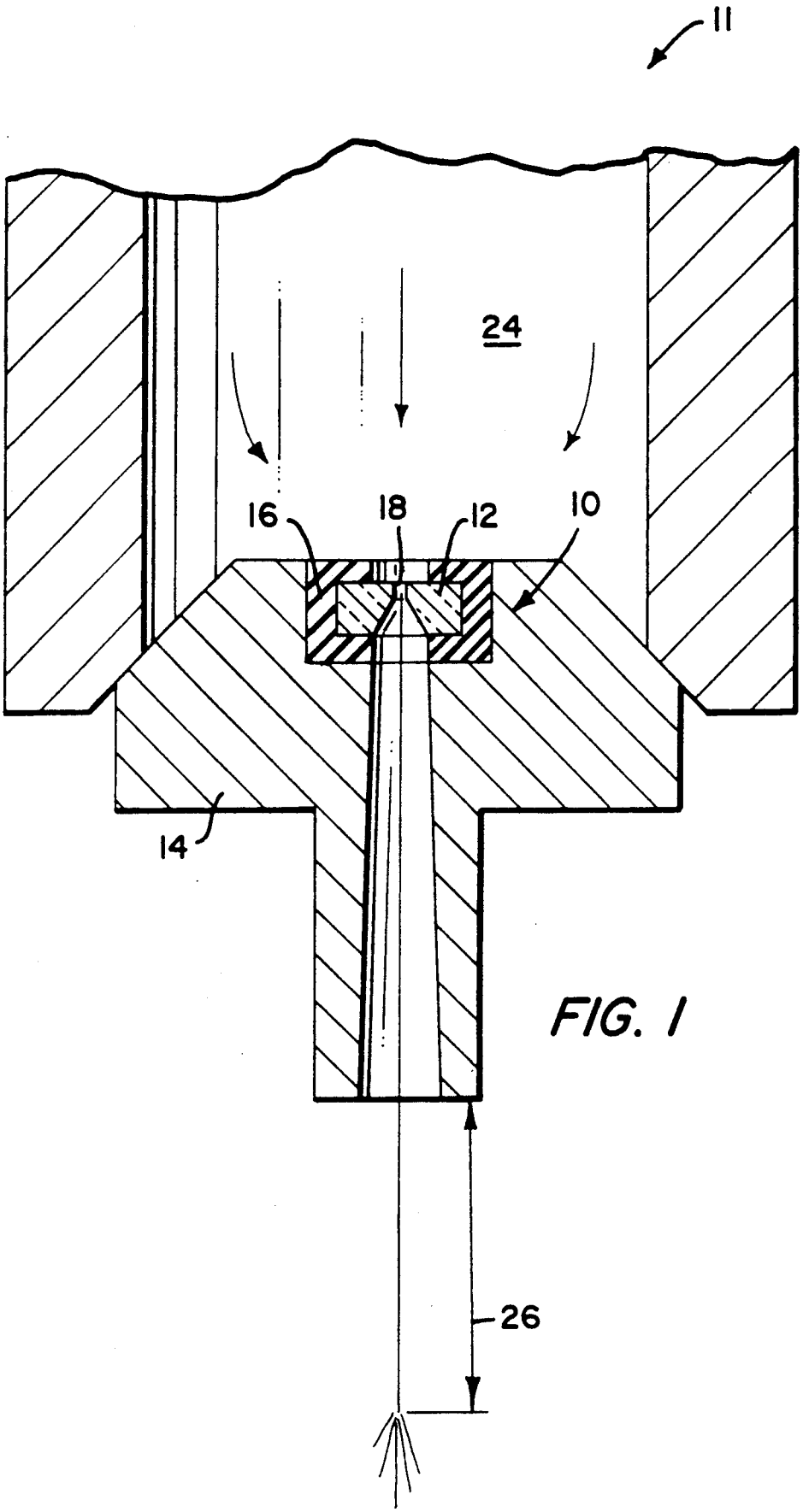
FIG. 1 is side cross sectional view illustrating an embodiment of a nozzle assembly of the instant invention.
Figure 2:
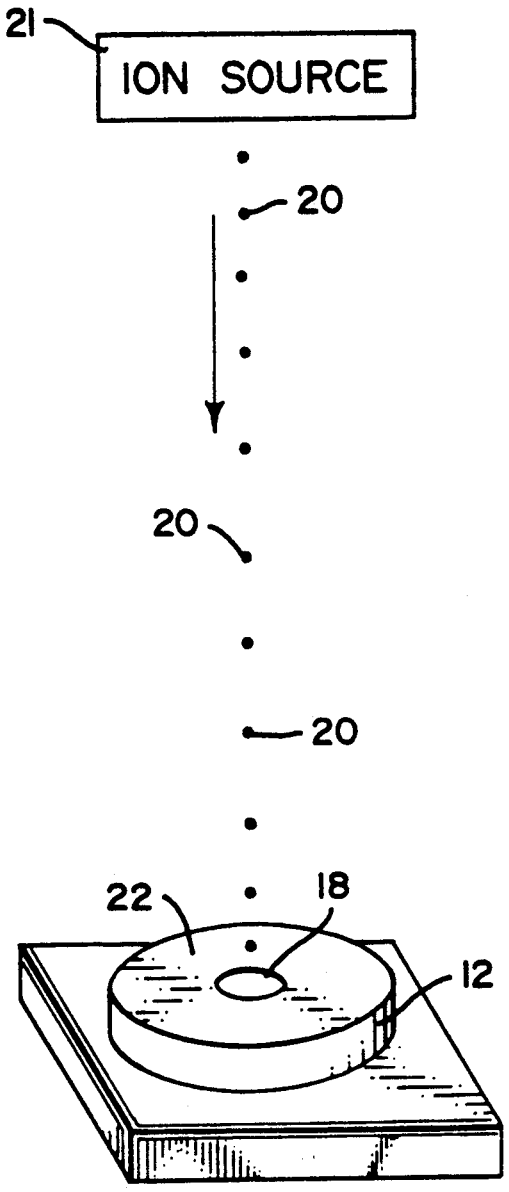
FIG. 2 is a view of one embodiment of ions being implanted into a nozzle of the instant invention.

A fluid nozzle assembly 10 of a waterjet cutter 11 contains a nozzle 12, a nozzle mount 14 which securely retains the nozzle, and a seal 16 which is of any construction which prevents flow of fluid between the nozzle 12 and the mount 14. During operation, fluid flows through a passage 18 in the nozzle 12 under extremely high pressures.

The fluid nozzle 12 is typically formed from a first material being a jewel such as diamond, corundum, or other jewel. The corundum family includes all oxides of aluminum which contain different impurities (such as sapphire, ruby and topaz). The nozzle often contains imperfections or may be formed from such a material, which can result in premature failure of the nozzle.

To prevent rapid deterioration of the nozzle 12 which results from stress cracking due to the imperfections, or due to chipping, wear and erosion caused by the working fluid/slurry, accelerated ions 20 (discharged from ion source 21) are implanted into parts of, or the entire external surface 22 of the nozzle. The ions are formed from a second material, different from the material of the nozzle, and may be applied in successive steps. Implantation of certain ions into the surface 22 has been found to increase the toughness, hardness, or the lubricity of the nozzle 12.

Use of ions of different densities and materials, as well as implanting the ions at different depths (by altering the amount and/or velocity which the ions are accelerated at the surface) will result in differing nozzle surface 22 characteristics, and different probable lifetimes of the nozzles under similar conditions.

While titanium, nickel and chromium have been successfully used as ions for this application, it is anticipated that a wide variety of ions could be used depending upon the nozzle material. Implanted nickel has been found to especially increase the life of sapphire nozzles. It is envisioned that other ions, or combinations of ions, would be especially suited for use on other ions.

A smooth and properly formed passage 18 is necessary for the correct functioning of the nozzle 12. Even a minute crack in the entrance and/or at the passage can result in disruption of a length of cohesive fluid flow, or fishline length 26 which is necessary for proper nozzle operation.

There are several ways which failure of the nozzle may be manifested under operation. The first is to have the nozzle 12 crack. The second is to have the critical geometry of the passage and/or entrance chipped or worn. Erosion may distort the passage and/or entrance 18.

There are several reasons why ion implantation increases useful lifetime of the nozzles. One reason is that the ions fill in molecular voids or micro cracks in the crystalline structure of the nozzle; thereby reducing the stresses exerted on the voids, and the resulting cracking of the nozzle. In this manner, the nozzle will last for the normal lifetime of the material which the nozzle is formed from, instead of failing early due to cracking.

Another reason why ion implantation increases useful lifetime is that the ions will affect the surface finish of the nozzle. A smooth nozzle surface finish will reduce the wear on the nozzle itself, thereby extending the nozzle's life.

Yet another reason is that a fluid 24 which the nozzle 12 is exposed to may be reactive with the nozzle material itself. The implantation of ions into the surface may reduce this reactivity.

Having described the invention, what is claimed is:

1. A fluid discharge apparatus comprising:

a nozzle, having a surface, the nozzle being constructed from a jewel; and an aggregation of ions, formed from a second material, different from said jewel, which are implanted onto the surface, whereby a useful lifetime of the nozzle, with a fluid passing through the nozzle under high pressure, is increased.

2. The apparatus as described in claim 1, wherein the second material includes nickel.

3. The apparatus as described in claim 1, wherein the second material includes titanium.

4. The apparatus as described in claim 1, wherein the second material includes chromium.

5. The apparatus as described in claim 1, wherein the jewel is a diamond.

6. The apparatus as described in claim 1, wherein the jewel is a corundum.

7. The apparatus as described in claim 6, wherein the jewel is a sapphire.

8. The apparatus as described in claim 1, wherein the useful lifetime is determined by a retention of a usable fishline stream length produced by fluid exiting the nozzle.

9. The apparatus as described in claim 1, further comprising:

an orifice formed in the nozzle, wherein the useful lifetime is determined by a retention of surface geometry of the entrance and/or passage of the nozzle.

10. A fluid discharge assembly comprising:

a nozzle, having a surface, the nozzle being constructed from a jewel;

an aggregation of ions, formed from a second material, different from the jewel, which are implanted onto the surface, whereby a useful lifetime of the nozzle, with a fluid passing through the nozzle under high pressure, is increased; and a nozzle mount for securely retaining the nozzle.

11. A fluid discharge apparatus comprising:

a nozzle, having a surface including imperfections, the nozzle being constructed from jewel; and an aggregation of ions, formed from a second material, different from jewel, which are implanted onto the surface, whereby the effects of the imperfections are decreased.

12. The apparatus as defined in claim 11, wherein the imperfections include micro cracks formed in the nozzle.

13. The apparatus as defined in claim 11, wherein the effects of the imperfections include cracking of the nozzle.

14. The apparatus as defined in claim 11, wherein the effects of the imperfections include reduction of finish of the surface.

* * * * *